United States Patent [19]

Sakashita et al.

[11] 4,138,917

[45] Feb. 13, 1979

[54] KEY CODE GENERATOR

[75] Inventors: Noriji Sakashita; Hiroshi Kitagawa, both of Hamamatsu, Japan

[73] Assignee: Kabushiki Kaisha Kawai Gakki Seisakusho, Hamamatsu, Japan

[21] Appl. No.: 811,638

[22] Filed: Jun. 30, 1977

[30] Foreign Application Priority Data

Jul. 2, 1976 [JP] Japan ..... 51-78645

[51] Int. Cl.[2] ..... G10H 1/00

[52] U.S. Cl. ..... 84/1.01; 84/1.03; 84/1.24; 84/DIG. 2; 340/365 R

[58] Field of Search ..... 84/1.01, 1.03, 1.24, 84/DIG. 2, DIG. 7, DIG. 23; 340/365 R, 365 S

[56] References Cited

U.S. PATENT DOCUMENTS

| | | | |
|---|---|---|---|
| 4,022,098 | 5/1977 | Deutsch | 84/1.01 |
| 4,041,825 | 8/1977 | Pasceita | 84/1.01 |

*Primary Examiner*—Robert K. Schaefer
*Assistant Examiner*—Leonard W. Pojunas, Jr.

[57] ABSTRACT

A key code generator for electronic musical instruments which has a switch matrix circuit having a plurality of switches disposed at the intersections of two sets of buses, means for simultaneously applying signals to the switch matrix circuit from one of the two sets of buses to derive outputs from a plurality of blocks into which the buses of the other set are divided line by line, a memory for detecting the blocks that even one switch is in the on state from the bus outputs of the switch matrix circuit and temporarily storing signals of the detected blocks, a first priority selector for selecting block signals in a predetermined order of priority from the bus outputs and sequentially outputting the block signals with a predetermined clock pulse, means for inhibiting the block detecting operation during outputting from the first priority selector and applying the selected block signals to the buses of the detected blocks to sequentially scan only the detected blocks, a second priority selector for selecting switch signals in a predetermined order of priority from respective switch signals of the scanned blocks and sequentially outputting the switch signals with a predetermined clock pulse, and means for preventing clock pulses from inputting to the first priority selector until the switch signals of each designated block are all outputted.

2 Claims, 12 Drawing Figures

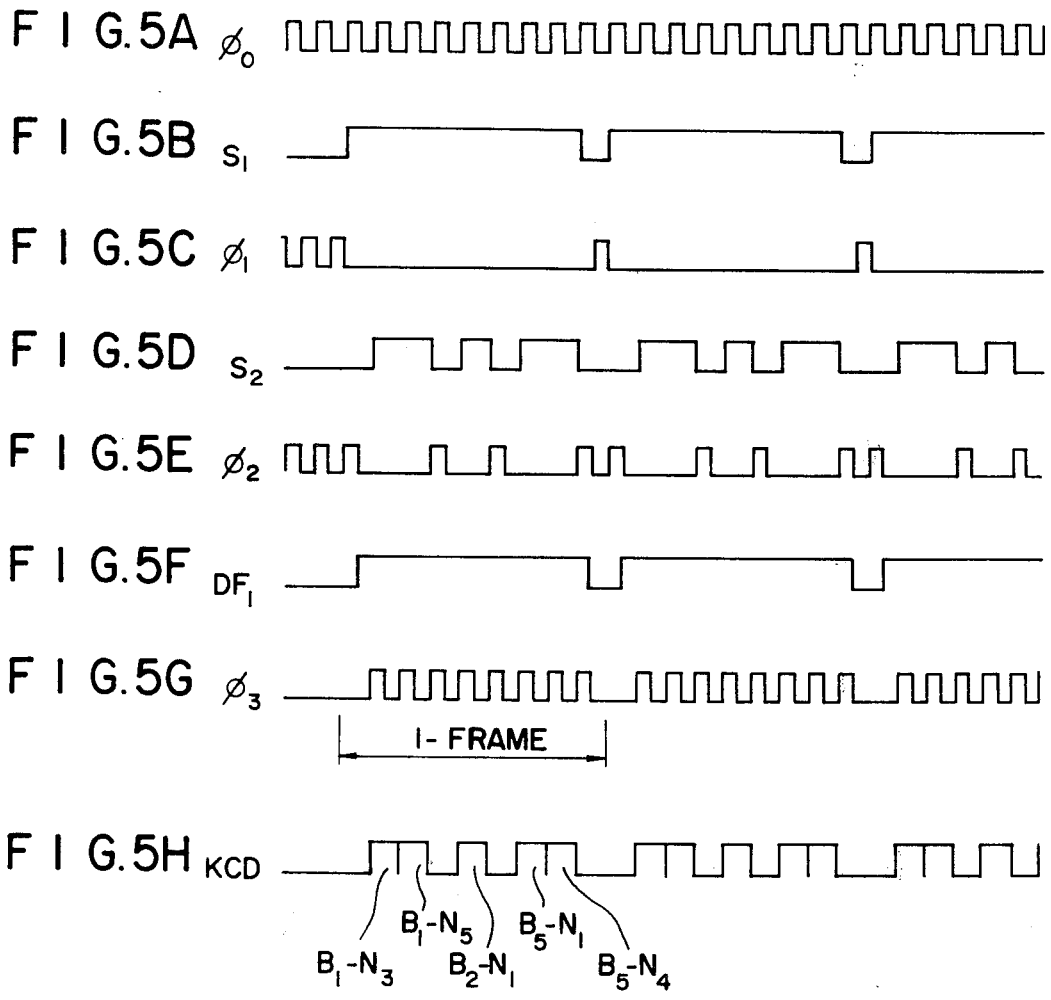
FIG.5A $\phi_0$
FIG.5B $S_1$
FIG.5C $\phi_1$
FIG.5D $S_2$
FIG.5E $\phi_2$
FIG.5F $DF_1$
FIG.5G $\phi_3$
1- FRAME
FIG.5H KCD
$B_1$-$N_3$
$B_1$-$N_5$
$B_2$-$N_1$
$B_5$-$N_1$
$B_5$-$N_4$

KEY CODE GENERATOR

BACKGROUND OF THE INVENTION

1. Field of the Invention

This invention relates to a key code generator for electronic musical instruments, and more particularly to a key code generator which generates key codes corresponding to closed switches of an electronic musical instrument.

2. Description of the Prior Art

In an electronic musical instrument having many key switches such as an electronic organ, if the switches are connected directly to desired circuits so as to supply thereto information of closing of the switches, the amount of wiring becomes very large. Further, in the case where the circuits to be connected with the switches are formed as an integrated circuit, the number of pins of semiconductor elements is limited, making it difficult to employ the integrated circuit. Moreover, conventional digital organs having a key assignor usually employ, as a method of detecting turned-on switches, a method of sending information of closed switches in the form of a TDM (Time-Division Modulation) signal or a PCM (Pulse Code Modulation) signal synchronized therewith, by time-division scanning of all switches. With this method, however, since the states of all of the switches are checked in the time-divisional manner, information of the switches in the off state is also sent. This leads to a decreased response speed and, for an increased response speed, it is necessary to raise the clock frequency. For instance, if one scanning period is 256 bits and if the clock frequency is 200 KHz, 1.26 ms. is needed for one scanning. Further, when the switch is turned on immediately after the scanning, outputting of the information lags by one scanning period, resulting in a time lag in response.

SUMMARY OF THE INVENTION

This invention has for its object to provide a key code generator which overcomes the abovesaid defects and is adapted so that only the time slot of information of a switch turned on is actuated to increase the response speed and prevent a time lag in response.

According to this invention, there is provided a key code generator which is composed of a switch matrix circuit having a plurality of switches disposed at the intersections of two sets of buses, means for simultaneously applying signals to the switch matrix circuit from one of the two sets of buses to derive outputs from a plurality of blocks into which the buses of the other set are divided line by line, a memory for detecting the blocks that even one switch is in the on state from the bus outputs of the switch matrix circuit and temporarily storing signals of the detected blocks, a first priority selector for selecting block signals in a predetermined order of priority from the bus outputs and sequentially outputting the block signals with a predetermined clock pulse, means for inhibiting the block detecting operation during outputting from the first priority selector and applying the selected block signals to the buses of the detected blocks to sequentially scan only the detected blocks, a second priority selector for selecting switch signals in a predetermined order of priority from respective switch signals of the scanned blocks and sequentially outputting the switch signals with a predetermined clock pulse, and means for preventing clock signals from inputting to the first priority selector until the switch signals of each designated block are all outputted.

BRIEF DESCRIPTION OF THE DRAWINGS

FIG. 5 is a timing charts showing the operation of this invention.

DESCRIPTION OF THE PREFERRED EMBODIMENTS

With reference to the drawings, the present invention will hereinafter be described with regard to its embodiment.

Figure 1:
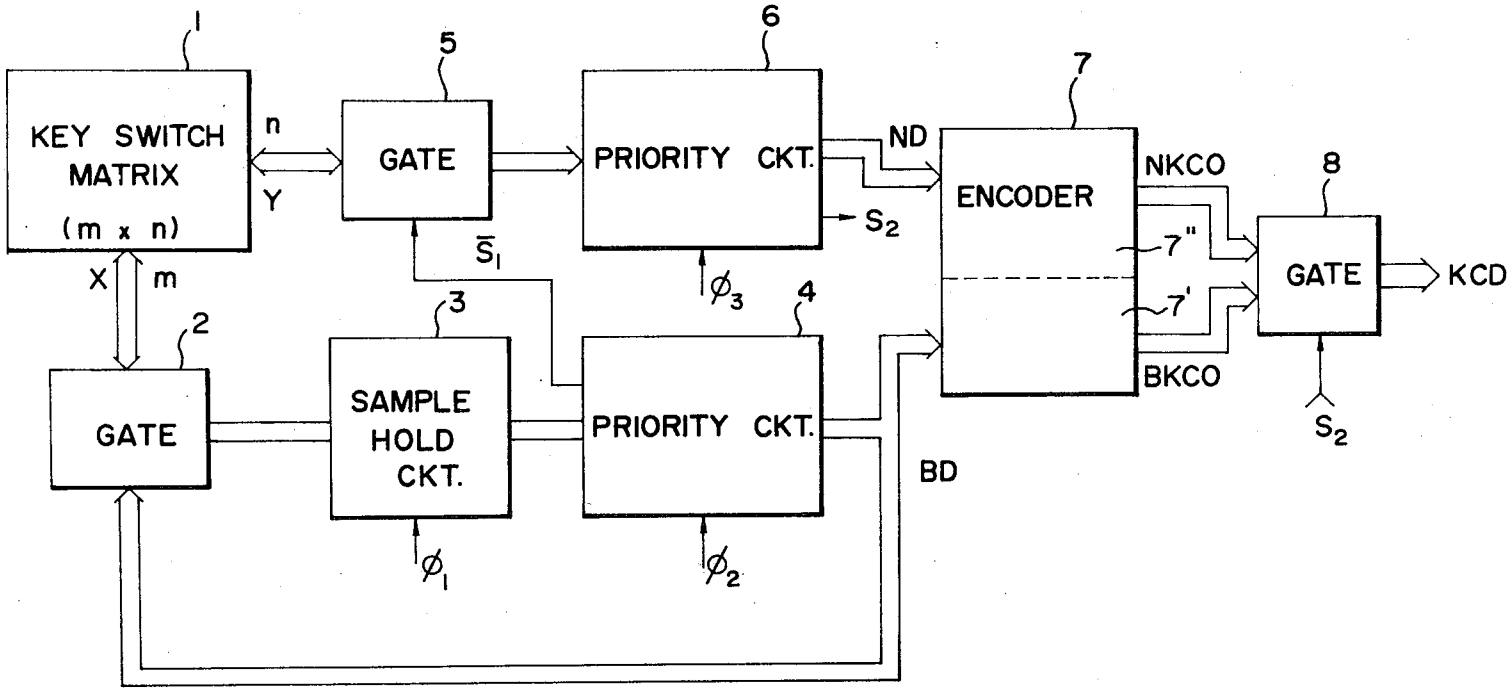
FIG. 1 is a block diagram illustrating the construction of an embodiment of this invention.

FIG. 1 is explanatory of the construction of the embodiment of this invention. In a key switch matrix circuit 1, switches are disposed at the intersections of m buses X and n buses Y and the switches are divided into m blocks, each including n switches. When a signal $\overline{S}_1$ is outputted to a gate circuit 5, "1" is applied to the bus Y through the gate circuit 5. Where even one switch is in the on state, "1" is outputted to the bus X. This output is applied through a gate circuit 2 to a sample hold circuit 3 in which blocks having key switches turned on are temporarily stored with clock pulses $\phi_1$. The output from the sample hold circuit 3 is applied to a priority circuit 4, and the blocks having the key switches turned on are sequentially selected by clock pulses $\phi_2$ in the order of priority and their signals are outputted from the priority circuit 4. The output thus derived from the priority circuit 4 is applied as block data BD to an encoder 7, and encoded into a binary code. Further, the block data BD is also applied to the gate circuit 2 to apply "1" to the buses corresponding to each of the blocks. At the same time, the signal $\overline{S}_1$ is made "0" and signals of the key switches in the block thus designated appear on the bus Y. This output is supplied to a priority circuit 6 through the gate circuit 5. With the priority circuit 6, the key switch signal of the highest priority level is selected, and then switched by a clock pulse $\phi_3$ to the key switch signal of the next priority level. Thus, key switch signals are sequentially selected and outputted from the priority circuit 6. The output thus obtained is applied as intra-block key data ND to an encoder 7, in which it is encoded into a binary code. In this case, a signal $S_2$ is "1" while the priority circuit 6 is selecting and outputting any one of the key switch signals, and the signal $\overline{S}_1$ is "0" while the priority circuit 4 is selecting and outputting any one of the block signals. The clock pulse $\phi_2$ is "0" when the signal $S_2$ is "1", and does not designate the next block until the key switch signals in the designated block are all outputted. When the block has thus been designated, the key switch signals of the designated block are outputted in the order of their priority levels and then the next block is designated in accordance with priority. After all the signals have thus been outputted, the signal $\overline{S}_1$ having the value "1" is applied again to the gate circuit 5, and written in the sample hold circuit 3. The data signals ND and BD thus outputted are inputted to the encoder 7, in which they are encoded into binary codes and from which is derived a key code data KCD corresponding to the key switch. The key code data KCD is gated with a signal $\overline{S}_2$ in a gate circuit 8 and shaped and outputted therefrom.

Figure 2:
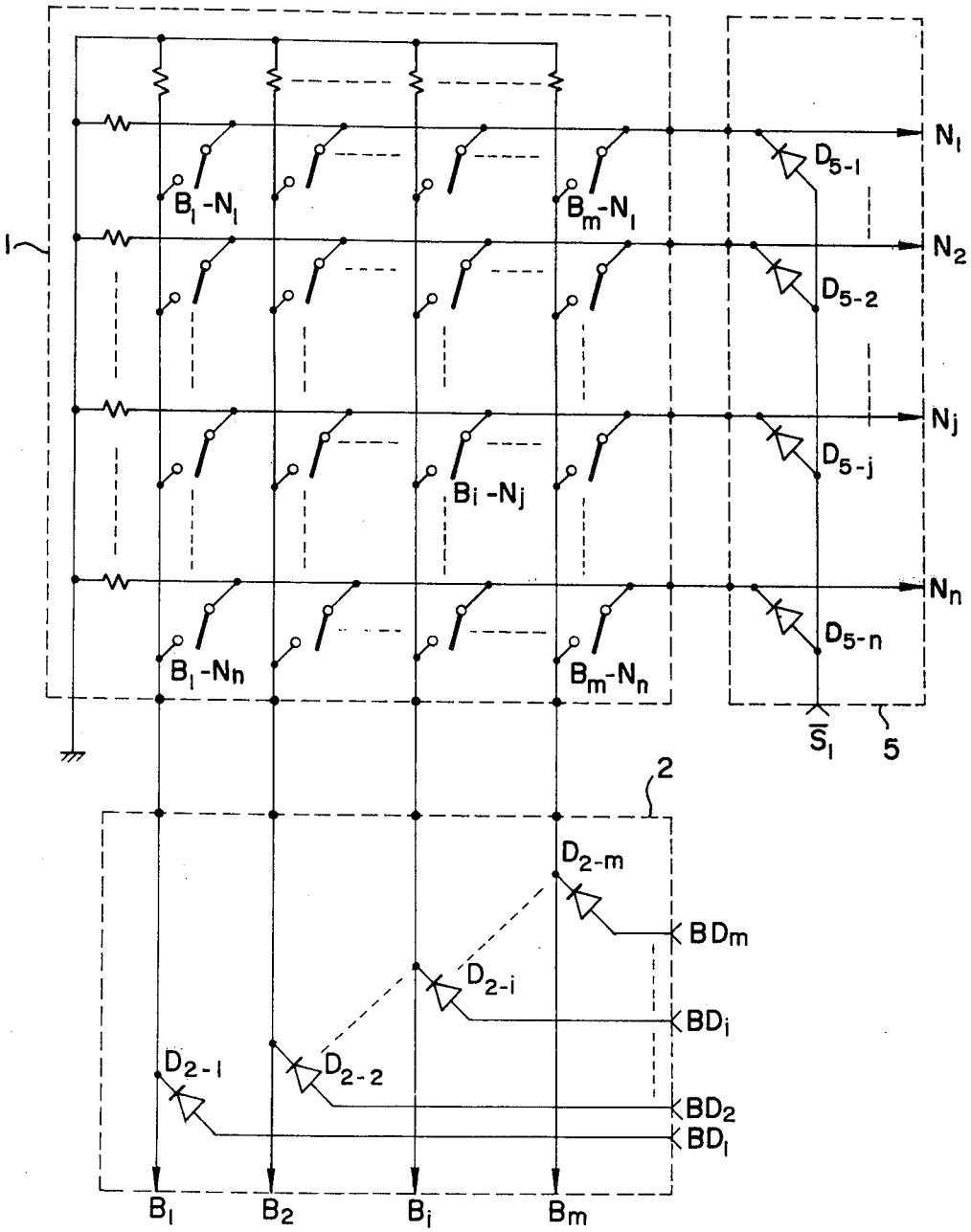
FIGS. 2 to 4 show in detail the principal parts of the embodiment depicted in FIG. 1.

FIG. 2 schematically illustrates the circuit constructions of the key switch matrix circuit 1 and the gate circuits 2 and 5 depicted in FIG. 1. Switches $B_1 - N_1$ to $B_m - N_n$ are respectively connected to buses $B_1$ to $B_m$ crossing buses $N_1$ to $N_n$, respectively. Assuming that the signal $\overline{S}_1$ is "1", the buses $N_1$ to $N_n$ are made "1" through diodes $D_{5-1}$ to $D_{5-n}$ and if any one of the switches is in the closed state, "1" is applied to any one of the buses $B_1$ to $B_n$ which are each indicative of the block. Conversely, where any one of block signals $BD_1$ to $BD_m$ is "1", the buses indicating the block are made "1" through that diodes $D_{2-1}$ to $D_{2-m}$ which corresponds to the block, and signals $N_r$ to $N_n$ of the switch in the block are made "1".

Figure 3:
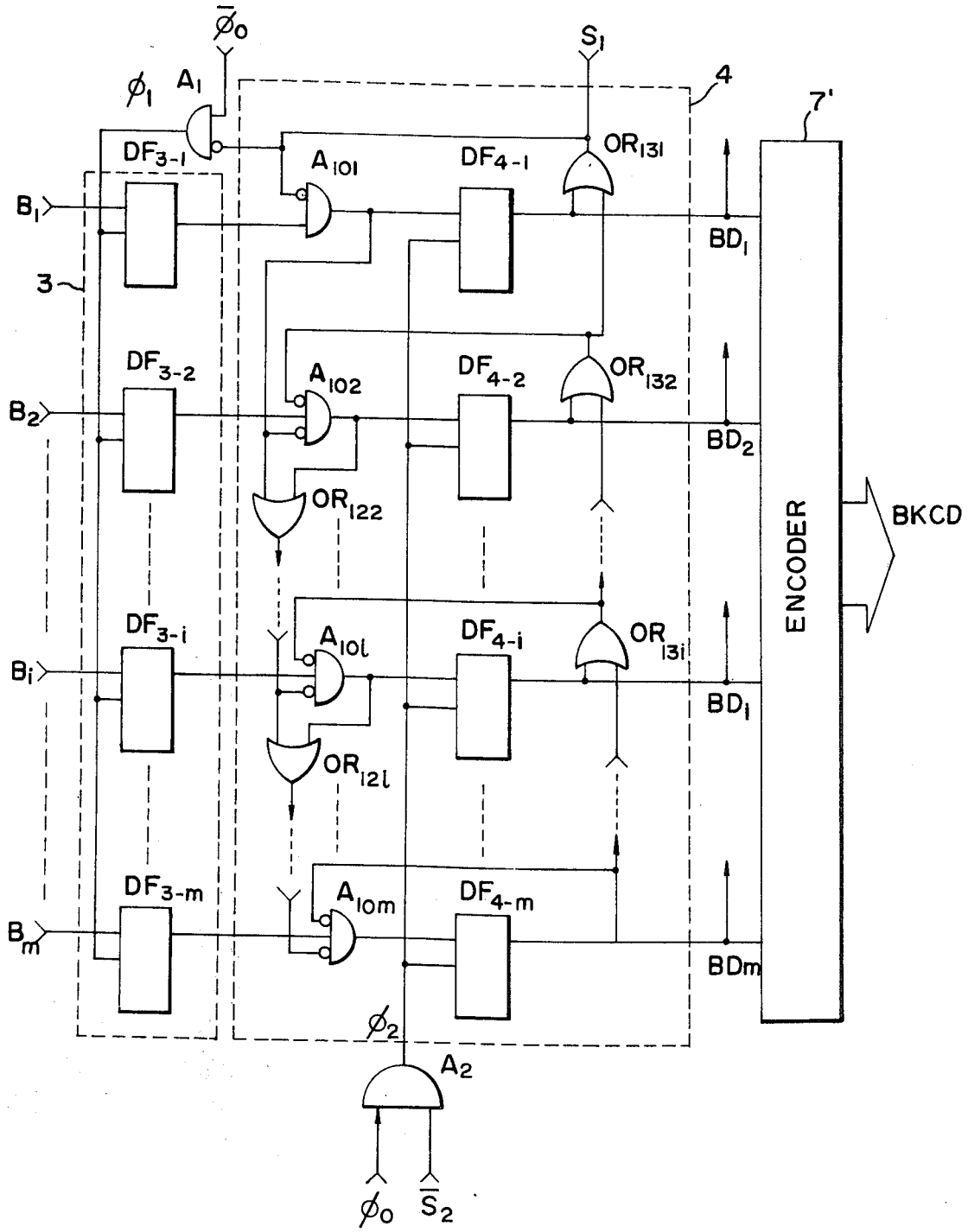

FIG. 3 schematically shows the circuit constructions of the sample hold circuit 3 and the priority circuit 4 depicted in FIG. 1. The block signals, which are derived from the switch matrix circuit 1 by making the signal $\overline{S}_1$ to be "1", are respectively applied to corresponding ones of D type flip-flops $DF_{3-1}$ to $DF_{3-m}$. Where the signal $S_1$ is "0", a clock pulse $\phi_0$ is applied by the inverted output $\overline{S}_1$ to an AND circuit $A_1$ and, by a clock pulse $\phi_1$ derived therefrom, the block signals $B_1$ to $B_m$ are temporarily stored in the D type flip-flops $DF_{3-1}$ to $DF_{3-m}$. Then, the outputs from these flip-flops are fed to AND circuits $A_{101}$ to $A_{10m}$. For instance, if the signal $B_i$ is "1", the AND circuit $A_{10i}$ is supplied with "1". Further, the AND circuit $A_{10i}$ is supplied with an inverted output from an OR circuit $_{13i}$ and also an inverted output from an OR circuit $OR_{12(i-1)}$ to provide an output "1". This output is fed to an OR circuit $OR_{12i}$ to cause it to prevent inputting to AND circuits $A_{10(i+1)}$ to $A_{10m}$ of the stages following the OR circuit $OR_{12i}$. The output from The AND circuit $A_{10i}$ is applied to a D type flip-flop $DF_{4-i}$. If, now, the signal $\overline{S}_2$ is "1", the clock pulse $\phi_0$ is applied as a clock pulse $\phi_2$ to D type flip-flops $DF_{4-i}$ to $DF_{4-m}$ from an AND circuit $A_2$. By the clock pulse $\phi_2$, the signal $B_i$ is latched. This output is fed to an OR circuit $OR_{13i}$, by which OR circuits $OR_{13(i-1)}$ to $OR_{131}$ preceding that $OR_{13i}$ are set at "1" to inhibit the signals $B_1$ to $B_i$ in the ABD circuits $A_{101}$ to $A_{10i}$. The block signals $BD_1$ to $BD_m$ selectively derived from the D type flip-flops $DF_{4-1}$ to $DF_{4-m}$ are applied to an encoder 7', and outputted therefrom in the form of a block key code BKCD. Next, in the case where the signal $\overline{S}_2$ is "1", the data selected after the above block data are latched by the clock pulses $\phi_2$ in the D type flip-flops $DF_{4-1}$ to $DF_{4-m}$, sequentially outputting block data. The block data $BD_1$ to $BD_m$ thus provided are fed to the diodes $D_{2-1}$ to $D_{2-m}$ of the gate circuit 2 shown in FIG. 2. At this time, the output signal $S_1$ from the OR circuit $OR_{131}$ is "1" and the signal $\overline{S}_1$ fed to the gate circuit 5 is "0". The designated block data are applied to the key switch matrix circuit 1 to derive key switch signals from the buses $N_1$ to $N_m$.

Figure 4:
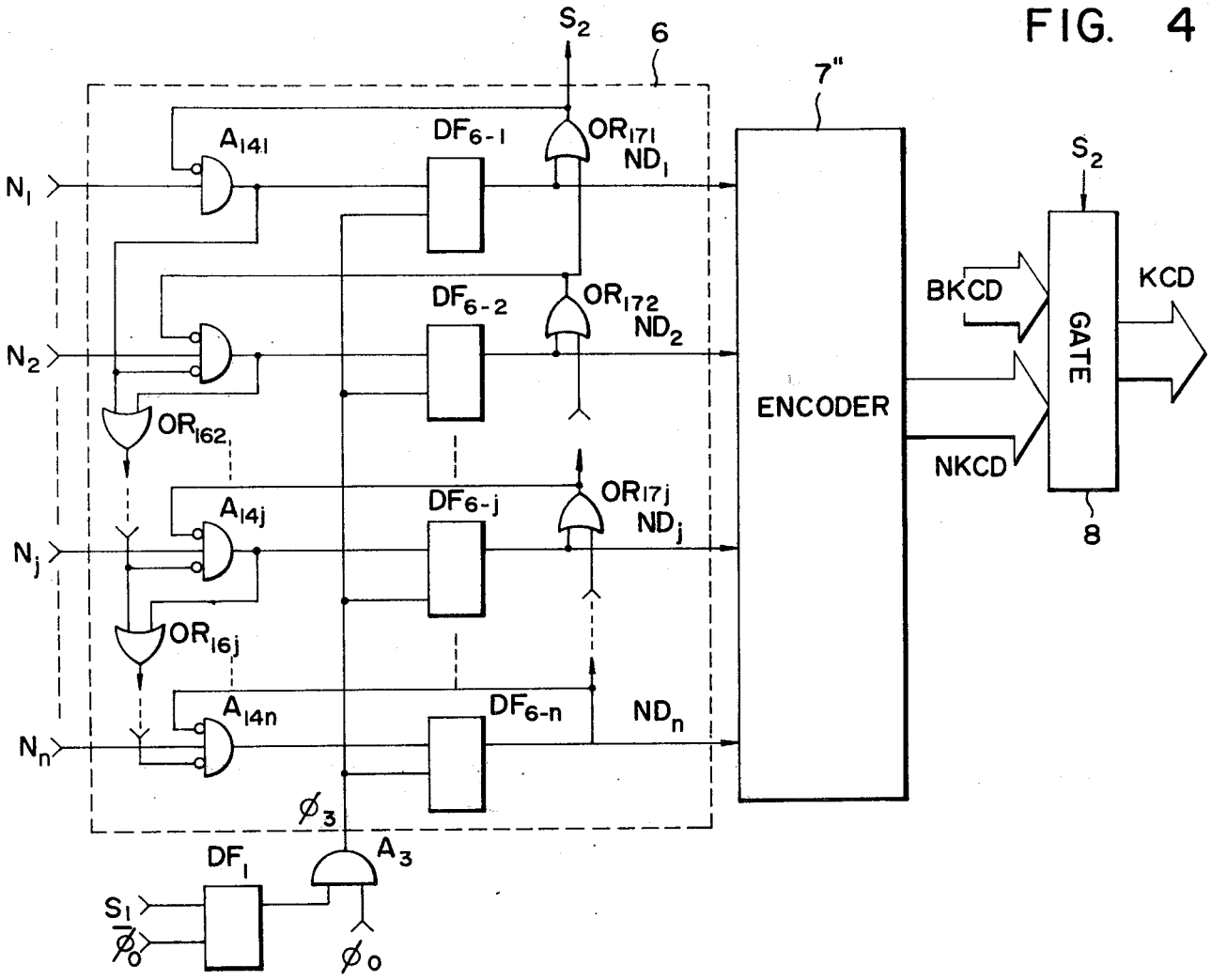

FIG. 4 is a circuit diagram of the priority circuit 6 shown in FIG. 1. The key switch signals $N_1$ to $N_n$ in the block outputted from the key switch matrix circuit 1 are supplied to AND circuits $A_{141}$ to $A_{14n}$. For example, if the signal $N_j$ is "1" and the outputs from OR circuits $OR_{17j}$ and $OR_{16(j-1)}$ after inverted, and the inverted outputs are both "1". Accordingly, the AND circuit $A_{14j}$ provides "1", which is fed to a D type flip-flop $DF_{6-j}$. And the output from the AND circuit $A_{14j}$ is applied to the OR circuit $OR_{16j}$ and, by the inverted outputs from the OR circuits $OR_{16j}$ to $OR_{16(n-1)}$, the signals $N_{j+1}$ to $N_n$ are inhibited in the lower-order AND circuits $A_{14(j+1)}$ *to* $A14_n$. On the other hand, the signal $S_1$ derived from the priority circuit 4 is "1" during the block designation and this signal is applied to a D type flip-flop $DF_1$ and once latched by the clock pulse $\phi_0$. Further, the output from the D type flip-flop $DF_1$ and the clock pulse $\phi_0$ are fed to an AND circuit $A_3$ to provide a clock pulse $\phi_3$. The signal $N_j$ is latched by the clock pulse $\phi_3$ in the D type flip-flop $DF_{6-j}$. The output from the D type flip-flop $DF_{6-j}$ is applied to an OR circuit $OR_{17j}$ to set higher-order OR circuits $OR_{171}$ or $OR_{17(j-1)}$ at "1". The outputs, after inverted, are supplied to the AND circuits $A_{141}$ to $A_{14j}$ to inhibit the signals $N_1$ to $N_j$ respectively corresponding thereto. Consequently, the following operation is performed with the signals $N_{j+1}$ to $N_n$, and these signals are selected and outputted in the order of priority. The thus incoming signals sequentially outputted by the clock pulse $\phi_3$. Further, the signal $S_2$ from the OR circuit $OR_{171}$ is "1" during selective outputting. Accordingly, the signal $S_2$ is fed to the AND circuit $A_2$ shown in FIG. 3 to inhibit the clock pulse $\phi_0$. That is, the clock pulse $\phi_0$ is inhibited so as not to designate the next block until the data in the preceding block are all outputted. Next, key switch signals $ND_1$ to $ND_n$ derived from the D type flip-flops $DF_{6-1}$ to $DF_{6-m}$ are applied to an encoder 7'', and ouputted as key code data NKCD corresponding to the key switches. The data BKCD and NKCD outputted from the encoders 7' and 7'' are supplied to the gate circuit 8, in which they are gated with the signal $S_2$ to provide the key code data KCD.

FIG. 5 is a timing chart of the respective clock pulses and signals during key code generation when the switches $B_1$ to $N_3$, $B_1$ to $N_5$, $B_2$ to $N_1$ $B_5$ to $N_1$ and $B_5$ to $N_4$ are simultaneously turned on based on the abovesaid circuit construction. That is, when the fundamental clock pulse $\phi_0$ of FIG. 5A and the signal $S_1$ of FIG. 5B, which concerns the blocks, are applied to the AND circuit $A_1$ after being inverted, the clock pulse $\phi_1$ of FIG. 5C is obtained, thereby to temporarily store the blocks in the sample hold circuit 3 shown in FIG. 3. The output from the sample hold circuit 3 is fed to the priority circuit 4, in which the blocks held in the on state are sequentially selcted by the clock pulse $\phi_2$ of FIG. 5E in the order of priority and from which they are outputted. The clock pulse $\phi_2$ is obtained by supplying the AND circuit $A_2$ with the fundamental clock pulse $\phi_0$ and an inverted signal of the signal $S_2$ which concerns the key switches in the block. As described above, the block data $BD_1$ to $BD_m$ derived from the priority circuit 4 are applied to the encoder 7' and the key switch signals of the designated block are generated on the buses Y of the key switch matrix circuit 1, and fed to the priority circuit 6. By this circuit, the key switch signal of the highest priority level is selected and then switched by the clock pulse $\phi_3$ of FIG. 5G to the switch signal of the next priority level, so that the key switch signals are thus selected and outputted one after another. This clock pulse $\phi_3$ is obtained by supplying the AND circuit $A_3$ with the fundamental clock pulse $\phi_0$ of FIG. 5A and the output waveform of FIG. 5F that the signal $S_1$ from the priority circuit 4 is applied to the D type flip-flop $DF_1$ and latched to one end by the clock pulse $\phi_0$. By the clock pulse $\phi_3$, the switch signals $ND_1$ to $ND_n$ are supplied to the encoder 7'' in accordance with their priority levels. Unless the switch signals of the preceding block are all outputted, the operation is not shifted to the next block. Accordingly, when the switches $B_1$ to $N_3$, $B_1$ to $N_5$, $B_2$ to $N_1$, $B_5$ to $N_1$ and $B_5$ to $N_4$ such as mentioned above are simultaneously turned on by the combinations of the block signals $BD_1$ to $BD_m$ and the switch signals $ND_1$ to $ND_n$ of FIG. 3, binary code data are sequentially provided in the above-said order of the switches, as illustrated in FIG. 5H.

In the present embodiment, the number of time slots forming one frame depends upon the number of those of switches in the blocks which are in the on state, and the number of blocks in the on state. Letting the numbers of switches and blocks in the on state by X and Y, respectively, the number T of time slots is given by $T = X + Y + 1$. By the priority circuits 4 and 6, the time slots of the blocks which are not in the on state are eliminated and, further, the time slots of the switches in the off state in the blocks which are in the on state, are also eliminated. In other words, only the time slots of the switches put in the on state are required.

As has been described in the foregoing, the present invention has the advantage that the number of lines connected between the switches and the circuit is reduced from $m \times n$ to $m + n$ by the employment of the key switch matrix to settle the problem of a limitation imposed on the number of pins by integration. Further, the priority circuits are provided respectively for the block data and the switch data and the two-way switch matrix is used, by which the time slots are made equal in number to switches put in the on state, thereby to provide for increased response speed. As a result of this, the clock frequency for driving the switches can be selected sufficiently low, and consequently, it is possible to neglect the influence of a delay in data which is caused by a waveform distortion due to the switching mechanism. Moreover, the key code generator of this invention is simple in construction, inexpensive and highly reliable.

It will be apparent that many modifications and variations may be effected without departing from the scope of novel concepts of this invention.

What is clamed is:

1. A key code generator for electronic musical instruments comprising:

a switch matrix circuit having a plurality of switches disposed at the intersections of two sets of buses, each line of one set of buses respectively designating a block of switches, and each line of the other set of buses respectively designating a switch line;

means for simultaneously applying signals to all the lines of said switch lines to simultaneously derive outputs from block lines;

a first memory for simultaneously detecting all the blocks having at least one switch in the on state from the bus outputs of the block lines and temporarily storing block signals representative of the detected blocks;

a first priority selector for selecting said block signals in a predetermined order of priority from said bus outputs and sequentially outputting said block signals with a predetermined clock pulse;

means for inhibiting the block detecting operation by said first memory during outputting from the first priority selector, and for applying the selected block signals to the block lines corresponding to the detected blocks to sequentially scan only the detected blocks;

a second priority selector for simultaneously detecting switch signal outputs from the switch lines of the scanned blocks which are in an on state an for selecting said switch signals in a predetermined order of priority and for sequentially outputting the switch signals with a predetermined clock pulse; and means for preventing clock pulses from inputting to the first priority selector until the switch signals of all designated block are outputted.

2. A key code generator for electronic musical instruments according to claim 1, wherein the first and second priority selectors each include a first gate circuit permitting the passage therethrough of the signal of the highest priority in accordance with a predetermined order of priority of a plurality of input signals, a second memory for temporarily storing the signal of the highest priority, and means for inhibiting an input signal higher in order than the signal being outputted and sequentially selecting the signals to be fed to the second memory by a predetermined clock pulse.

* * * * *